US006651468B2

(12) United States Patent
Aramburu et al.

(10) Patent No.: US 6,651,468 B2
(45) Date of Patent: Nov. 25, 2003

(54) CLUTCH DEVICE FOR LOCKS

(75) Inventors: Luis Angel Ruano Aramburu, San Sebastian (ES); Fermin Menta San Miguel, Irún (ES)

(73) Assignee: Talleres de Escoriaza, S.A. (ES)

( * ) Notice: Subject to any disclaimer, the term of this patent is extended or adjusted under 35 U.S.C. 154(b) by 0 days.

(21) Appl. No.: 10/037,549

(22) Filed: Nov. 9, 2001

(65) Prior Publication Data

US 2002/0139156 A1 Oct. 3, 2002

(30) Foreign Application Priority Data

Dec. 11, 2000 (ES) ..... 200002958

(51) Int. Cl.[7] ..... E05B 47/06

(52) U.S. Cl. ..... 70/222; 70/189; 70/277; 70/278.7; 70/279.1; 70/283

(58) Field of Search ..... 70/218, 222, 277, 70/189, 188, 422, 278.7, 279.1, 283, 472, 149

(56) References Cited

U.S. PATENT DOCUMENTS 4,429,556 A * 2/1984 Kambic ..... 70/149
4,995,248 A * 2/1991 Liu ..... 70/107
5,027,629 A * 7/1991 Liu ..... 70/277
5,475,996 A * 12/1995 Chen ..... 70/277 X
5,640,863 A * 6/1997 Frolov ..... 70/283
5,813,261 A * 9/1998 Boehlow ..... 70/379 R
5,953,942 A * 9/1999 Doucet et al. ..... 70/283
5,987,945 A * 11/1999 Ruano Aramburu ..... 70/277
6,286,347 B1 * 9/2001 Frolov ..... 70/472
6,363,762 B1 * 4/2002 Kueng ..... 70/278.3

FOREIGN PATENT DOCUMENTS

SE 153513 * 2/1956 ..... 70/492

* cited by examiner

*Primary Examiner*—Lloyd A. Gall
(74) *Attorney, Agent, or Firm*—Nields & Lemack

(57) ABSTRACT

Clutch device for locks which consists of an interior axis, an exterior axis, a frame or static body, an elastic element, a radial trigger, a radial trigger lock and a radial actuator; wherein: the interior axis, exterior axis and static body comprise a coaxial assembly in which the exterior axis penetrates an axial cavity of the interior axis while both axes are assembled within the static body, the elastic element is in a fixed relative position with respect to the static body and in an annular housing defined between this static body and the interior axis, the radial trigger is lodged in a movable position within the interior axis and has a length equal to the difference between the exterior diameter of the exterior axis and the interior diameter of the static body, the radial trigger lock is installed within the exterior axis with its tip in the exterior diameter of this exterior axis and with its tail end placed against one end of a radial compression spring.

3 Claims, 5 Drawing Sheets

1
2
3
4,42
5
6
7
8
9
10
11
12
13
14
14a
14b
43
43a
43b
43c
43d

CLUTCH DEVICE FOR LOCKS

FIELD OF THE INVENTION

This invention concerns a clutch device capable of determining the rotary coupling between a primary axis and a secondary axis, in such a manner that the primary axis can selectively rotate or not rotate while connected to the secondary axis.

This device is specially designed for locks, whether mechanical or electromechanical, taking as the primary axis the axis which is inside the lock (interior axis) and as the secondary axis the one which is on the outside (exterior axis).

PRIOR ART

In this field, improvements in features or adaptation to more modern (electronic) technologies are frequently achieved on the basis of implementing modifications to the composition of existing locks, rather than presenting a new design.

This leads to configurations which complicate the form, number, or assembly of the pieces; in addition to the fact that they are often valid only for solving the problem of improvements in features or technological adaptation that has motivated the modification in relation to a concrete type of lock and not to others with a similar application. For this reason one has to take into account the great variety of types of locks according to whether they have exterior or interior activation using a conventional key, a knob or handle, a conventional key and a knob or handle, or using electromechanic mechanisms with a knob, handle or cylinder, etc.

DESCRIPTION OF THE INVENTION AND ITS ADVANTAGES

In response to this situation, the present invention proposes a clutch device which responds to a compact design conceived specifically for the purpose of selective rotary coupling between two axes, and which is compatible with mechanically or electromechanically activated locks with or without knobs or interior and or exterior handles.

This clutch device, or clutch, for door locks consists of an interior axis, an exterior axis, a frame or static body, an elastic element, a radial trigger, a radial trigger lock and a radial activator; wherein said interior axis, exterior axis and static body make up a coaxial assembly in which the exterior axis penetrates into an axial cavity of the interior axis with a rotary adjustment while both axes are assembled with a rotary adjustment within the static body, said elastic element is in a fixed relative position with respect to the static body and in an annular housing which is defined between this static body and the interior axis, said radial trigger is lodged in a movable position within the interior axis and has a length equal to the difference between the exterior diameter of the exterior axis and the interior diameter of the static body, said radial trigger lock is installed within the exterior axis with its tip in the exterior diameter of this exterior axis and with its tail end applied against one end of a radial compression spring which has its other end at the base of a radial enclosure, said radial actuator is installed through the static body with the possibility of operative slippage between respective inhibited and extended positions in that one end of the actuator, which is directed toward the inside of the clutch, remains situated, respectively, in the exterior diameter of the interior axis and in a location intermediate to the exterior and interior diameters of this interior axis; and wherein said radial actuator has associated with it several mechanical or electromechanical pushing means, and tends to remain axially aligned with said radial trigger and trigger lock for an initial rotary position in which the clutch device is at rest.

The function is simple and is based on the fact that while the radial actuator is not activated (it is disengaged), it as well as the radial trigger and trigger lock remain correctly housed within their respective static body, interior axis and exterior axis in such a manner that these last two can rotate independently within the first, so that if we connect only the interior axis to the basic mechanism of the lock, we can open it from the interior but not from the exterior. In contrast, upon activating the radial actuator, the compression of the radial spring of the trigger lock makes it possible to retract the trigger lock and, consequently, the radial trigger remains halfway between the interior axis and the exterior axis in such a way that if the exterior axis is rotated, the interior axis will be caused to rotate, thus achieving the opening of the door from the exterior once the activation of the radial actuator is accomplished by mechanical or electromechanical means.

In the following, two possible embodiments of the recommended clutch are detailed, which are based on other such constructions of the cited elastic element.

DRAWINGS AND REFERENCES

To better understand the nature of the present invention, in the attached drawings, we represent a preferred industrial embodiment, which is shown only as an illustrative and non-limiting example.

Figures 13, 14:
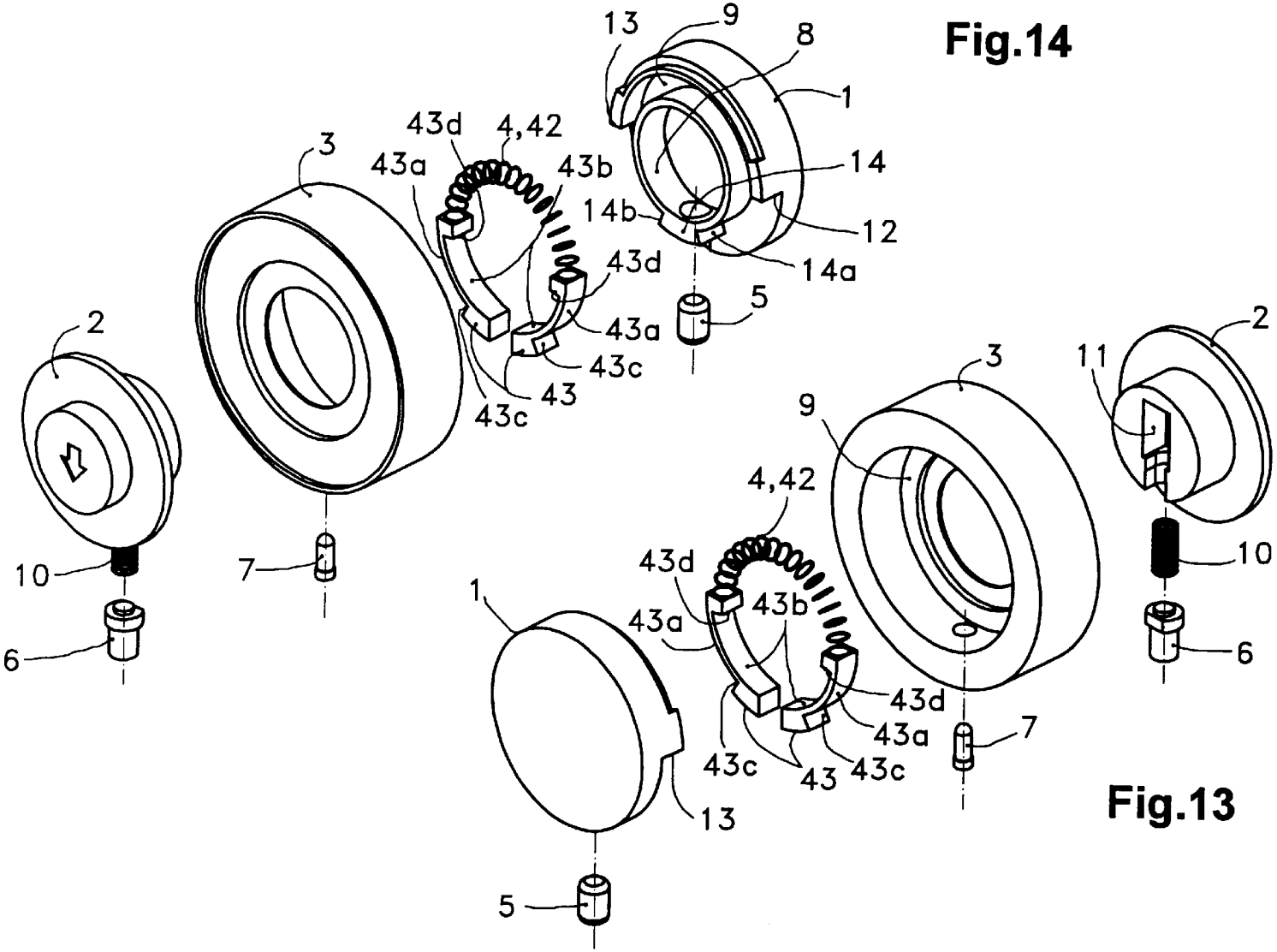
FIGS. 13 and 14 are, respectively, similar to FIGS. 1 and 2, but referring to another variant of embodiment of the proposed device.
Figure 15:
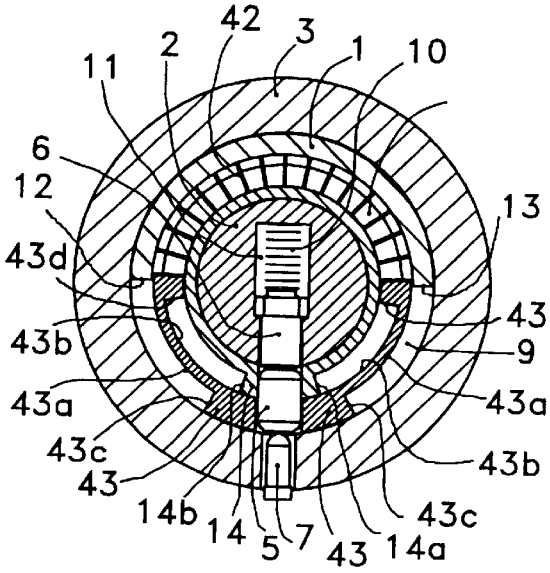
Figure 16:
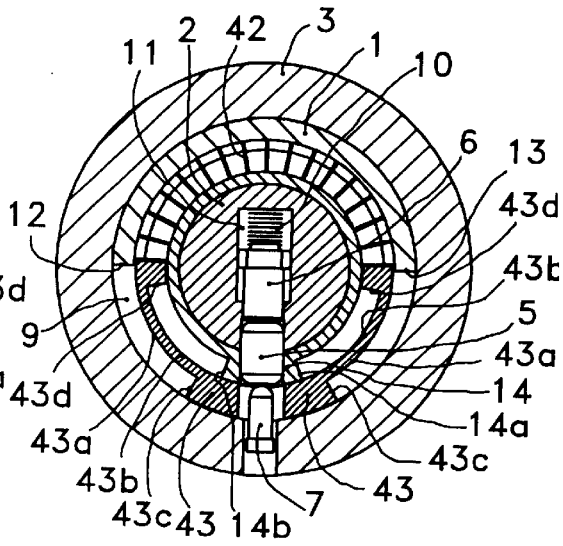
Figure 17:
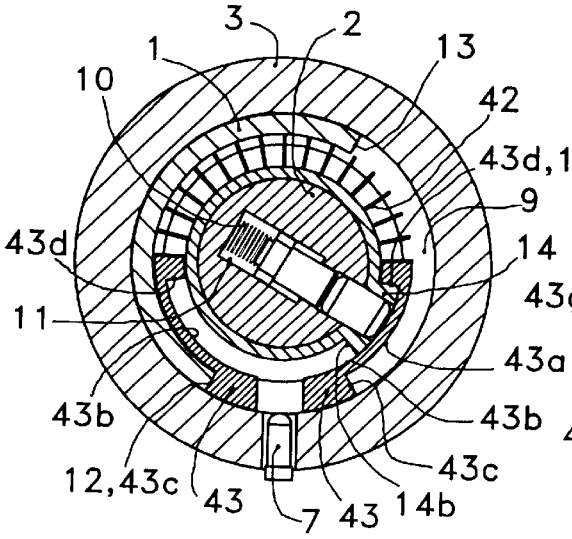
Figure 18:
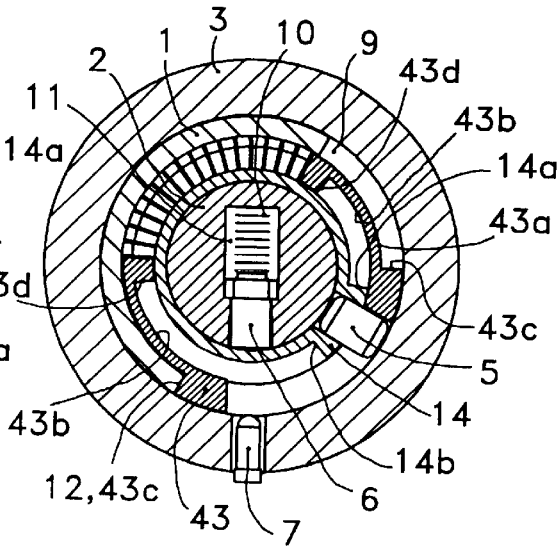

FIGS. 15, 16, 17 and 18 are respectively similar to FIGS. 6, 7, 11 and 12, but referring to the variant of embodiment represented in FIGS. 13 and 14.

In these figures the following references are indicated:

1—Interior axis

2—Exterior axis
3—Static body
4—Elastic element
5—Radial trigger
6—Radial trigger lock
7—Radial actuator
8—Axial cavity of interior axis (1)
9—Annular housing
10—Radial compression spring
11—Radial enclosure of exterior axis (2)
12—First radial face of interior axis (1)
13—Second radial face of interior axis (1)
14—Inferior stop in the interior axis (1)
14*a*—Side of the inferior stop (14)
14*b*—Side of the inferior stop (14)
41—Open annular band as elastic element (4)
41*a*—Central part of band (41)
41*b*—Arms of band (41)
41*c*—Bezel of arms (41*b*)
42—Helical annular spring as elastic element (4)
43—Rigid terminals of annular spring (42)
43*a*—First edge or exterior edge of terminals (43)
43*b*—Second edge or interior edge of terminals (43)
43*c*—First radial wall of terminals (43)
43*d*—Second radial wall of terminals (43)

DESCRIPTION OF A PREFERRED EMBODIMENT

With relation to the drawings and references enumerated above, two variants of embodiment of the proposed clutch for locks are illustrated in the attached drawings.

Figures 1, 2:
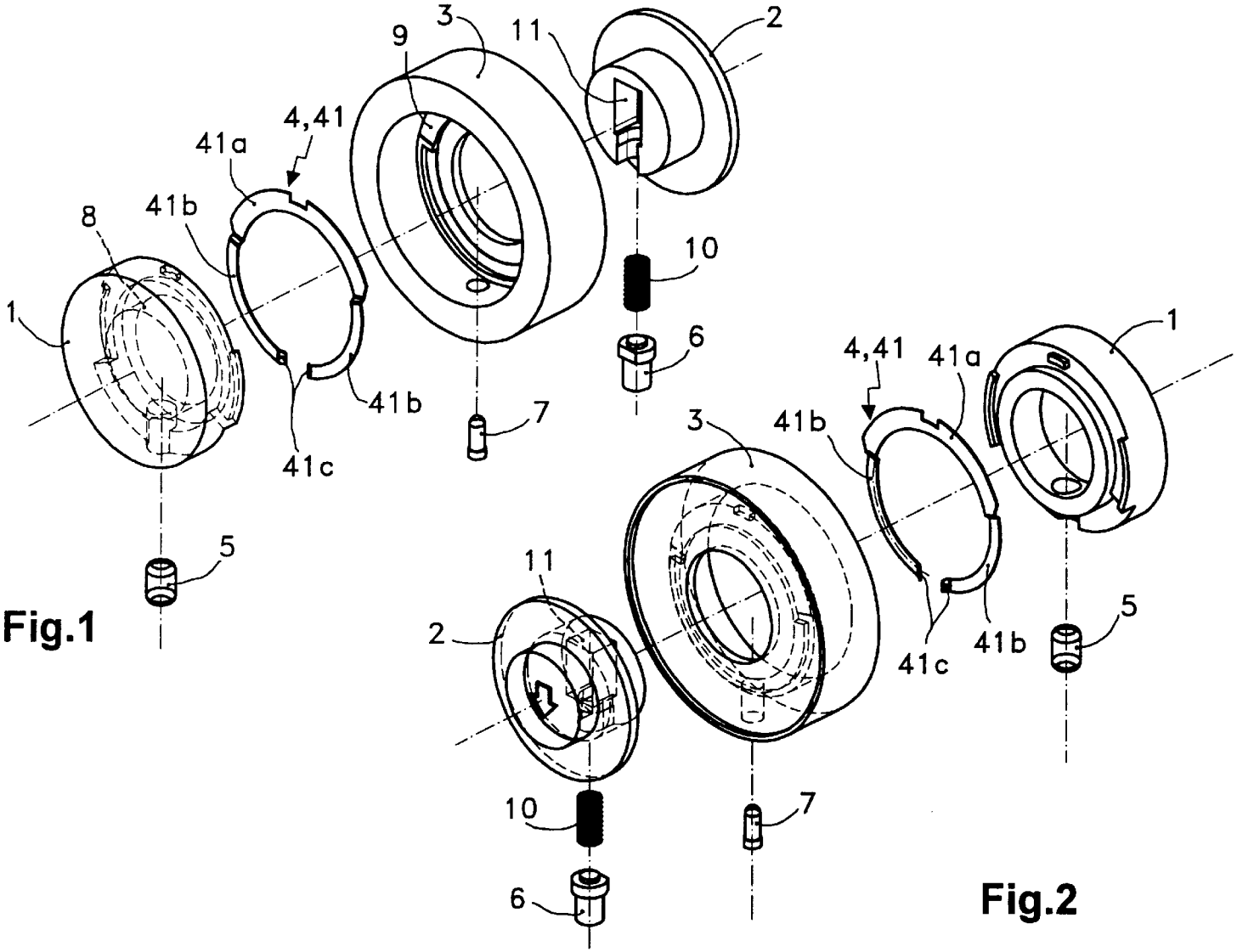
FIG. 1 is an exploded view from the perspective of a variant of embodiment of the device of the invention, as seen from the side of interior axis (1).
FIG. 2 is similar to FIG. 1, but seen from the side of the exterior axis (2).
Figure 5:
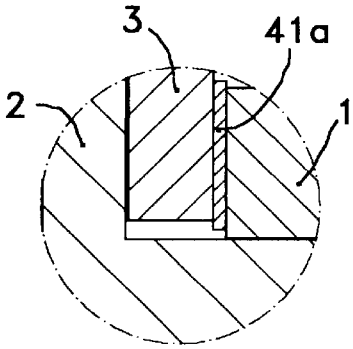
FIG. 5 is an enlargement of detail V indicated in FIG. 4.
Figure 4:
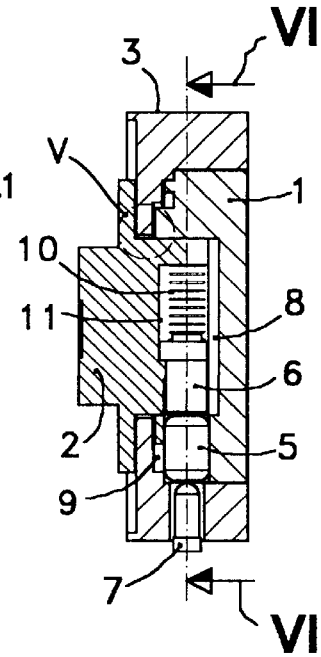
FIG. 4 is an enlargement of section IV—IV, which is marked in FIG. 3.
Figure 3:
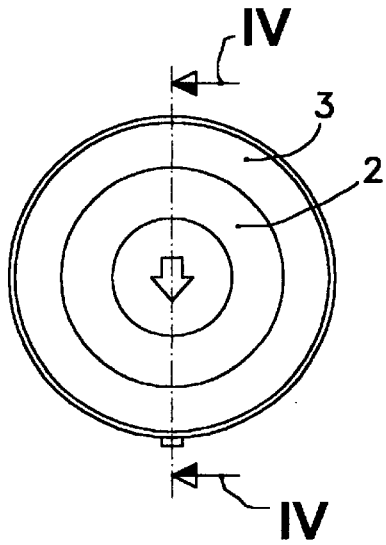
FIG. 3 is a view in orthogonal projection of the device in FIGS. 1 and 2, shown frontally at the end of the exterior axis (2).

Referring to the first of these two variants of embodiment, FIGS. 1 and 2 clearly illustrate the characteristic construction of this clutch device, which consists of an interior axis (1), an exterior axis (2), a frame or static body (3), an elastic element (4), a radial trigger (5), a radial trigger lock (6) and a radial actuator (7); wherein: said interior axis (1), exterior axis (2) and static body (3) make up a coaxial assembly in which the exterior axis (2) penetrates, with a rotary adjustment, into an axial cavity (8) of the interior axis (1) while both axes (1, 2) are assembled with a rotary adjustment within the static body (3), said elastic element (4) is in a fixed relative position with respect to the static body (3) and in an annular housing (9) which is defined between this static body (3) and the interior axis (1), said radial trigger (5) is lodged in a movable position within the interior axis (1) and has a length equal to the difference between the exterior diameter of the exterior axis (2) and the interior diameter of the static body (3), said radial trigger lock (6) is installed within the exterior axis (2) with its tip in the exterior diameter of this exterior axis (2) and with its tail end placed against one end of a radial compression spring (10) which has its other end at the base of a radial enclosure (11), said radial actuator (7) is installed by means of the static body (3) with the possibility of operative slippage between respective inhibited and extended positions in that one end of the actuator, which is directed toward the inside of the clutch, remains situated, respectively, in the exterior diameter of the interior axis (1) and in a location intermediate to the exterior and interior diameters of this interior axis (1); and wherein said radial actuator (7) has associated with it several mechanical or electromechanical pushing means, and tends to remain axially aligned with said radial trigger (5) and trigger lock (6) for an initial rotary position in which the clutch device is at rest.

In this version, the elastic element (4) is an open annular band (41) which has a central part (41*a*) semi-detached from the static body (3), which slopes toward the interior side of the lock forming two arms (41*b*) which project cantilevered within said annular housing (9). In this part of the annular housing (9), the axial depth is greater than the sum of the thickness of said radial trigger (5) and one of said arms (41*b*), and arms (41*b*) situate their ends collaterally adjacent to the cylindrical semi-periphery of said radial trigger (5) which is oriented toward the exterior side of the lock.

The assembly is illustrated by FIGS. 4, 5, 6, and 10. It is to be pointed out that: the annular bed (41) remains (FIG. 5) with its central part (41*a*) trapped between the interior axis (1) and the static body (3), staying immobilized to the second at all times, while (FIG. 10) the arms (41*b*) of the same remain cantilevered within the annular housing (9) and with their ends (FIG. 6) located collaterally to the radial trigger (5); the trigger (5), the trigger lock (6) and the actuator (7) remain (FIG. 4) radially aligned in the initial situation of rest and disengagement of the device.

Figure 6:
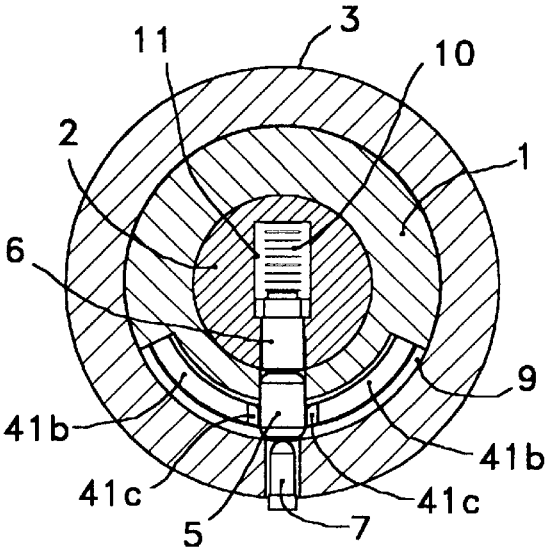
FIG. 6 is section VI—VI marked in FIG. 4, and it shows the resting or disengaged state of the device of the invention.
Figure 7:
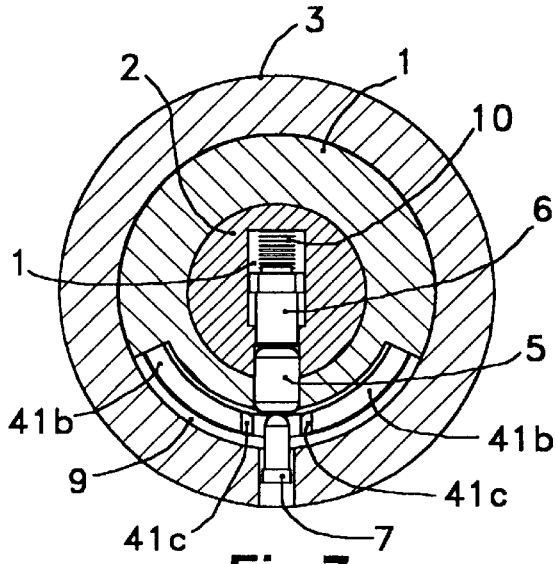
FIG. 7 is similar to FIG. 6, but showing the engaged state of the device.
Figure 10:
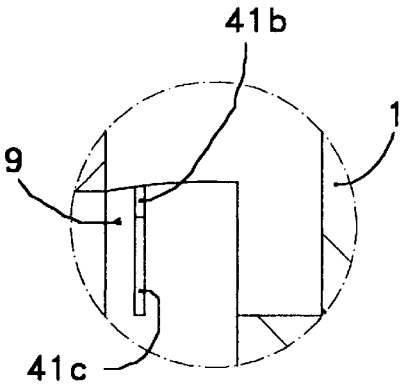
FIG. 10 is an enlargement of detail X circled in FIG. 9.
Figure 9:
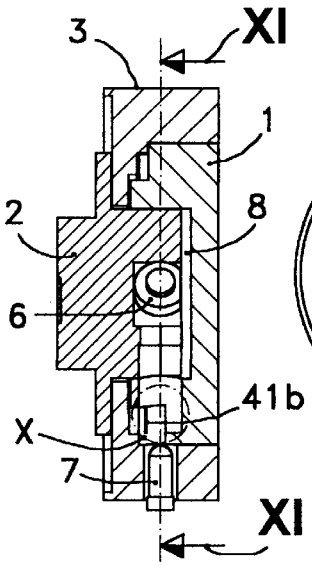
FIG. 9 is the conventional broken section marked in FIG. 8 and shows the engaged state with the exterior axis (2) rotated.
Figure 8:
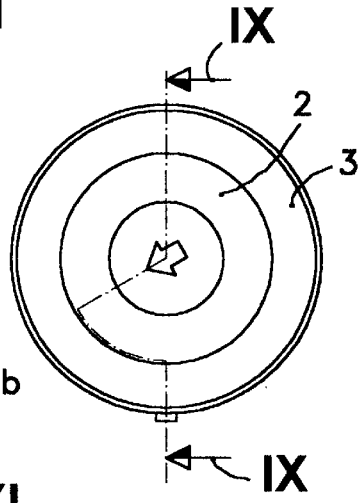
FIG. 8 is similar to FIG. 3, but with the exterior axis (2) rotated.
Figure 11:
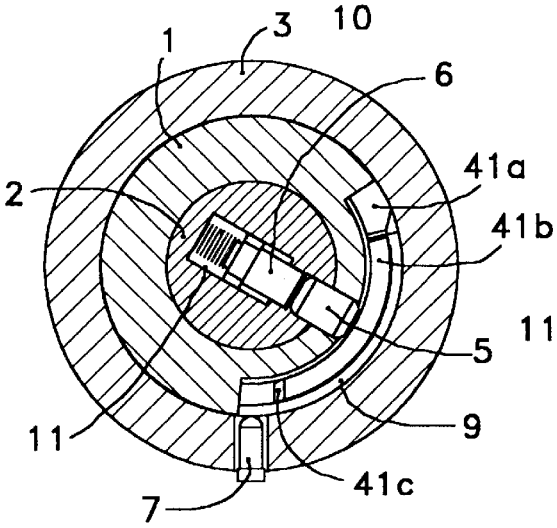
FIG. 11 is section XI—XI marked in FIG. 9.
Figure 12:
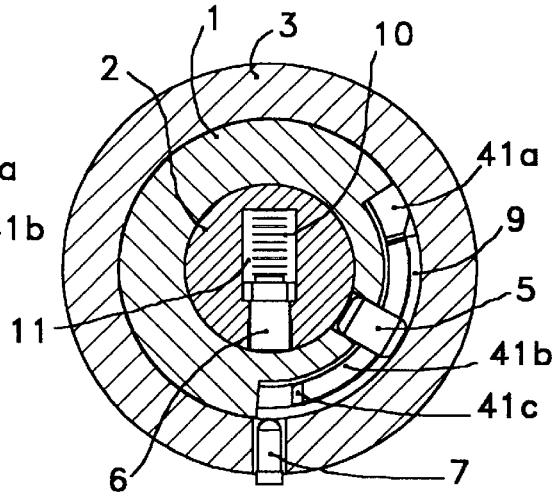
FIG. 12 is similar to FIG. 6 (disengaged), but with interior axis (1) rotated.

FIGS. 6, 7, 11 and 12 are illustrative of the functioning of the clutch. FIG. 6 (like FIG. 4) corresponds to said initial state of rest and disengagement; from this point we can rotate the exterior axis (2) without creating a pull on the interior axis (1) (an option which is not shown), as we could also autonomously rotate the interior axis (1), which is represented in FIG. 12. FIG. 7 shows the engaged state (produced by the activation of the radial actuator (7)), from which point the interior (1) and exterior (2) axes remain rotationally coupled by means of trigger (5) which has retracted the trigger lock (6) against the radial spring (10) in such a way that, if we associate the basic mechanism of a lock only with the interior axis, in a disengaged state it will always be able to be opened from the inside of the installation but not from the exterior; and in an engaged state it will also be able to be opened from the outside because the exterior axis (2) pulls on the interior axis (1). When the clutch is disengaged, the trigger (5) is displaced against the elasticity of the arms (41*b*) of the band, as shown in FIG. 12; to facilitate the attack of trigger (5) against the ends of arms (41*b*) placed in its path, these have at their ends respective bezels (41*c*) directed toward the exterior side of the lock. In contrast, in the engaged state (FIG. 11), trigger (5) passes over the edge of smaller radius of arms (41*b*).

FIGS. 13 to 18 illustrate a second variant of embodiment of the invention in which said elastic element (4) is constituted by a helical annular compression spring (42) installed centrally between two rigid terminals (43), which axially to the clutch have a thickness which fits tightly but is movable with respect to said annular housing (9) and which locate their free ends collaterally adjacent to said radial trigger (5) and which, in the direction of rotation, these rigid terminals (43) each present two edges; a first or exterior edge (43*a*) which extends rotationally between the end of said central spring (42) and a first radial wall (43*c*) near the free end of the rigid terminal (43) and with respect to the periphery of the clutch is restricted by the internal wall of the static body (3) and a second or interior edge (43*b*) which extends rotationally between the free end and a second radial wall (43*d*) of the rigid terminal (43) and toward the axis of the clutch is restricted by the smaller radius of the annular housing (9). As can be appreciated in FIG. 18, also in a disengaged state, the rotation of the interior axis (2) causes the trigger (5) to be displaced against the elasticity of the elastic element (4), in this case, the helical annular spring (42). In contrast, in an engaged state (FIG. 17), the trigger slides over the edge of smallest diameter of rigid terminals (43) which cap said annular spring (42), in this case designated as the second edge (43*b*).

In this variant, it can be observed that said first (43*c*) and second (43*d*) radial walls are rotationally opposite, the first (43*c*) with radial faces (12 and 13) of the interior axis (1) and the second radial walls (43*d*) with the sides (14*a* and 14*b*) of the inferior stop (14) which exists in the interior axis (1).

It should be noted that in both variants the embodiments are symmetrical in order to allow the indifferent rotation of the interior (1) and exterior (2) axes in one or the other direction.

What is claimed is:

1. Clutch device for locks, characterized in that, with relation to the interior and exterior sides of a lock installed in a door, the device consists of an interior axis (1), an exterior axis (2), a frame or static body (3), an elastic element (4), a radial trigger (5), a radial trigger lock (6) having a tip and a tail end, and a radial actuator (7); wherein: said interior axis (1), exterior axis (2) and static body (3) comprise a coaxial assembly in which the exterior axis (2) penetrates, with a rotary adjustment, into an axial cavity (8) of the interior axis (1) while both axes (1, 2) are assembled with a rotary adjustment within the static body (3), said elastic element (4) is in a fixed relative position with respect to the static body (3) and in an annular housing (9) which is defined between said static body (3) and the interior axis (1), said radial trigger (5) is lodged in a movable manner within the interior axis (1) and has a length equal to the difference between the exterior diameter of the exterior axis (2) and the interior diameter of the static body (3), said radial trigger lock (6) is installed within the exterior axis (2) with its tip in the exterior diameter of this exterior axis (2) and with its tail end placed against one end of a radial compression spring (10) which has its other end at the base of a radial enclosure (11), said radial actuator (7) is installed by means of the static body (3) with the possibility of operative sliding between respective inhibited and extended positions in which one end of the actuator, which is directed toward the inside of the device, remains situated, respectively, in the exterior diameter of the interior axis (1) and in a location intermediate to the exterior and interior diameters of this interior axis (1); and wherein said radial actuator (7) tends to remain axially aligned with said radial trigger (5) and trigger lock (6) for an initial rotary position in which the clutch device is at rest.

2. Clutch device for locks, according to claim 1, wherein said elastic member (4) is an open annular band (41) which has a central part (41*a*) semi-detached from the static body (3), which slopes toward the interior side of the lock forming two arms (4*b*) which project cantilevered within said annular housing (9) where the axial depth is greater than the sum of the thicknesses of said radial trigger (5) and of one of said arms (41*b*), and whose arms (41*b*) situate their ends collaterally adjacent to the cylindrical semi-periphery of said radial trigger (5), which is oriented toward the exterior side of the lock.

3. Clutch device for locks, according to claim 2, further characterized in that, at the ends of said arms (41*b*) of the annular band (41) there are respective bezels (41*c*) directed toward the exterior side of the lock.

* * * * *